United States Patent [19]

Radimer et al.

[11] 4,144,144

[45] Mar. 13, 1979

[54] ELECTROLYTIC PRODUCTION OF SODIUM PERSULFATE

[75] Inventors: Kenneth J. Radimer, Little Falls; Michael J. McCarthy, Trenton, both of N.J.

[73] Assignee: FMC Corporation, Philadelphia, Pa.

[21] Appl. No.: 839,538

[22] Filed: Oct. 5, 1977

Related U.S. Application Data

[63] Continuation-in-part of Ser. No. 753,756, Dec. 23, 1976, abandoned, and Ser. No. 753,758, Dec. 23, 1976, abandoned.

[51] Int. Cl.[2] ..... C25B 1/28

[52] U.S. Cl. ..... 204/82; 204/93

[58] Field of Search ..... 204/82, 93

[56] References Cited

U.S. PATENT DOCUMENTS

| | | | |
|---|---|---|---|
| 1,059,809 | 4/1913 | Adolph et al. | 204/82 |
| 3,399,090 | 8/1968 | Caropreso et al. | 156/19 |
| 3,406,108 | 10/1968 | Radimer et al. | 204/82 |
| 3,716,629 | 2/1973 | Miller | 923/513 |
| 3,791,946 | 2/1974 | Owens | 204/82 |
| 3,915,816 | 10/1975 | Rossberger | 204/82 |
| 3,927,189 | 12/1975 | Jayawant | 423/513 |
| 3,954,952 | 5/1976 | Hall | 423/513 |

FOREIGN PATENT DOCUMENTS

| | | | |
|---|---|---|---|
| 164465 | 8/1955 | Australia. | |
| 81404 | 5/1895 | Fed. Rep. of Germany | 204/82 |
| 205069 | 12/1908 | Fed. Rep. of Germany | 204/82 |
| 508524 | 7/1939 | United Kingdom | 204/82 |

OTHER PUBLICATIONS

Wood, "Chemistry & Industry", Jan. 3, 1953, pp. 2–6.
Chemical Abstracts, 111215z, vol. 79, 1973.
Chemical Abstracts, 85:150934b.
Chemical Abstracts, 85:38723f.
Chemical Abstracts, 85:38716f, 1976.
Chemical Abstracts, 85:132775w.

*Primary Examiner*—T. Tung
*Attorney, Agent, or Firm*—Charles C. Fellows; Frank Ianno

[57] ABSTRACT

Preparation of sodium persulfate in an electrolytic cell having a protected cathode is obtained by the direct electrolysis of aqueous anolyte solution in which there is initially dissolved a sufficient amount of a mixture of sulfates and peroxydisulfates of sodium and ammonium to provide an anolyte feed solution containing by weight 5 to 9% sodium ions, 12 to 30% sulfate ions, 1 to 4% ammonium ions, an effective amount of a polarizer, and optionally up to 20% peroxydisulfate ions. The cell catholyte is a sulfuric acid solution, which may contain $Na^+$ and $NH_4^+$ values, and the electric current density is at least 0.5 amperes per square centimeter of platinum surface of the anode.

12 Claims, No Drawings

ELECTROLYTIC PRODUCTION OF SODIUM PERSULFATE

This application is a continuation-in-part of U.S. Ser. No. 753,756 filed Dec. 23, 1976, and U.S. Ser. No. 753,758 also filed Dec. 23, 1976, both not abandoned.

This invention relates to the electrolytic production of sodium persulfate using a neutral anolyte feed solution.

Salts of peroxydisulfuric acid, particularly ammonium peroxydisulfate and sodium peroxydisulfate are chemicals which have been found particularly useful by the printed circuit industry as the best available materials for cleaning copper before plating and soldering operations. Ammonium peroxydisulfate, also commonly termed ammonium persulfate, is easily produced by electrolytic processes. However, ammonium persulfate introduces ammonium ions into the solution used in cleaning copper which ions are objectionable because they can lead to formation of complexes with copper making it difficult to remove copper from waste streams; this leads to contamination of streams by copper. Furthermore, fixed nitrogen in the form of ammonium salts is ecologically undesirable in waste streams as it constitutes a fertilizer for algae.

Sodium peroxydisulfate, also commonly termed sodium persulfate, cleans copper very well and avoids the problems caused when using ammonium persulfate to clean copper. Unlike ammonium persulfate, sodium persulfate is not easily made electrolytically, and although much work has been done to develop electrolytic processes for producing sodium persulfate a suitable efficient process has not been previously developed. It is known to produce sodium persulfate by reaction in an aqueous solution of ammonium persulfate and sodium hydroxide under controlled temperature and pressure conditions. The resulting sodium persulfate is generally recovered by spray drying or vacuum crystallization. This process liberates ammonia as a gas which is known to mix explosively with oxygen which is available from the air or from persulfate decomposition.

Sodium persulfate has been prepared by direct electrolysis. Usually the electrolysis involved an aqueous solution of sodium sulfate and sulfuric acid as a feed or starting solution. Electrolysis of solutions containing initially sodium sulfate and ammonium sulfate and sulfuric acid have been described in which the relatively small amounts of sodium sulfate were used to facilitate obtaining higher concentrations of dissolved persulfate. Attempts to prepare pure sodium persulfate by direct electrolysis have generally been unsuccessful, however, because low current efficiencies, on the order of 30%, were obtained.

The use of polarizers has been suggested in acidic sulfate electrolytes containing either sodium or ammonium cations (but not both) to improve current efficiency. Nevertheless, the history of the direct electrolytic preparation of sodium persulfate is replete with accounts of difficulty and failure because of low current efficiencies obtained and the lack of sufficient knowledge of the phase diagrams required to deal adequately with electrolytic sodium persulfate production.

In accordance with the present invention, there is provided a process for the direct electrolytic preparation of sodium persulfate with high current efficiencies in an electrolytic cell having a protected cathode by the direct electrolysis of neutral aqueous anolyte feed solution in which there is initially dissolved a sufficient amount of a mixture of sulfates and peroxydisulfates of sodium and ammonium to provide an anolyte feed solution containing by weight 5 to 9% sodium ions, 12 to 30% sulfate ions, 1 to 4% ammonium ions, an effective amount of a polarizer, and optionally up to 20% peroxydisulfate ions. In a batch process, the sulfate content of the anolyte feed solution should be as high as possible. The cell catholyte is a sulfuric acid solution, which may contain $Na^+$ and $NH_4^+$ values, and the electric current density is at least 0.5 amperes per square centimeter of anode surface when the anode is platinum. Very high anode current densities, 1.5 amps/sq. cm or higher, could be used but the power cost would be excessive and physical problems, such as "gas blanking" of the cathode by hydrogen gas, would occur.

The process of the present invention can be utilized as a continuous cyclic process for the direct electrolytic preparation of sodium peroxydisulfate ($Na_2S_2O_8$) with high current efficiencies in a plurality of electrolytic cells having protected cathodes by the direct electrolysis using neutral aqueous anolyte feed solutions in which there is dissolved a sufficient amount of a mixture of sulfates and peroxydisulfates of sodium and ammonium to provide a neutral anolyte solution containing by weight at least 50% water, 18–30% total sulfates of which at least 35% of the total sulfate is ammonium sulfate and an effective amount of a polarizer. Conversions (see page 8) in the process are maintained in the order of 65–80% and current usage is varied to obtain the conversions in this range. Electric current usage of 199,400 amp hours per 10,000 pounds of solution produced a conversion of 80%. The cell catholyte is a sulfuric acid solution and the current density employed to obtain the desired conversion is at least 0.5 amperes per square centimeter of platinum surface of the anode. Very high current densities, 1.5 or 2 amps/sq. cm or higher, could be used but the power cost would be excessive and physical problems, such as "gas blanking" of the cathode by hydrogen gas, would occur. The sodium persulfate is typically recovered by evaporating water to cause the sodium persulfate to crystallize and the crystals are recovered by conventional means, typically by centrifuging the crystal slurry. Such vacuum crystallization and centrifuging techniques are common industrial chemical processes. The separated liquid, termed mother liquor, is mixed with the cathode product and neutralized with sodium hydroxide. This neutralized solution is recycled to the anode side of the electrolytic cells as the neutral aqueous anode feed solution.

The neutral anolyte feed solution (containing no free acidity) is initially prepared from salts such as sodium sulfate, ammonium sulfate, ammonium peroxydisulfate, and other salts that can provide the necessary sodium, ammonium, sulfate and optionally peroxydisulfate ions. Recycled neutral anolyte feed solutions generally contain some peroxydisulfate ions. The salts can be employed up to about their solubility limits in the feed solution but in a cyclic process are generally used in amounts of about 30–50% by weight depending upon the temperature of the solution and the solubility characteristics of the salts selected. Dilute solutions can be used but they are economically disadvantageous.

The electrolysis is conducted in an electrolytic cell having a protected cathode. A protected cathode is a cathode which is separated from the anolyte solution by a porous dielectric material. The preferred type of cell is divided into two compartments by a diaphragm made from a non-conducting porous material. Porous ceramic materials such as alumdum, plastic or other porous dielectric materials are used to separate the anolyte from the catholyte. The anodes are chemically resistant materials such as platinum, lead oxide, silicon carbide, chromium carbide and so forth with platinum being the preferred anode. The preferred cathode is lead although carbon and metal such as tin, aluminum, zirconium, platinum, nickel and their alloys are satisfactory.

The neutral feed anolyte may contain a reducing agent such as a sulfite compound to destroy sodium permonosulfate, also termed Caroate. The feed anolyte once it is in the electrolytic cell should contain a polarizer to obtain best anode current efficiencies. Generally polarizers provide cyanide, thiocyanate, cyanate, fluoride, ferrocyanide, ferricyanide, chloride or perchlorate ions. Cyananamide, urea and thiourea are also useful polarizers. The best polarizers are ammonium thiocyanate and cyanamide. When a polarizer of a type which forms cyanide is employed it may be advisable to remove the cyanide from the exit anolyte, by aeration, for example, prior to neutralizing the anolyte. It is possible to monitor the anode current efficiency and add more polarizer as required to maintain current efficiency.

In the cyclic process of this invention a sulfuric acid feed catholyte and a neutral feed anolyte containing sodium, ammonium, sulfate and persulfate ions and a polarizer and if desired a reducing compound are electrolyzed in cells with protected cathodes, generally diaphragm cells. The exit analyte may be neutralized before or after sodium persulfate is crystallized from the exit analyte by evaporation of water. The liquid fluid from the crystallizers, often termed mother liquor, is combined with the acidic exit catholyte; this mixture is neutralized, generally with sodium hydroxide, and recycled to the electrolytic cells as feed anolyte. Thus the raw materials for the cyclic process are principally sulfuric acid and sodium hydroxide.

The electrolytic cell operating temperature should be as low as can be economically produced without causing crystallization in the cells. The temperature at which crystallization begins to occur depends on the concentrations of salts in the feed anolyte. Temperatures below 10° C. are unnecessarily low and those above 40° C. are undesirably high because excessive decomposition of the desired product occurs. Typical useful temperature ranges are from about 20° to 35° C. Low temperatures minimize hydrolysis of the sodium peroxydisulfate to the undesired sodium permonosulfate, but maintaining low cell temperatures is costly. The product sodium peroxydisulfate is more soluble in water than the starting materials such as sodium sulfate; therefore the temperature during the first part of the electrolysis must be kept higher than during the latter part of the electrolysis.

The term "conversion" as it is used in this patent specification and claims refers to the fraction or the percentage of the sulfur in solution which is present in the form of persulfate.

At the beginning of a batch electrolysis with an anolyte containing sulfate as the only anion, current efficiencies for conversion of sulfate to persulfate at the anode will be slightly higher at the beginning of the batch electrolysis than they will be after a substantial part of the sulfate has been converted to persulfate. This occurs because the concentration of sulfate decreases during the batch electrolysis, and water, rather than sulfate, is oxidized to an increasing extent. As the current efficiency for persulfate production decreases, first gradually and then more rapidly, the persulfate concentration is, nonetheless, increasing, at first very nearly proportionately to the length of the electrolysis, and then at a rate which begins to decrease slightly as a result of the decreasing current efficiency. The percent current efficiency drops and the conversion percentage rises from zero; eventually the two percentages become equal, following which the conversion percentage exceeds the current efficiency. The percentage at which the conversion percentage becomes equal to the current efficiency percentage has been referred to as the "crossover;" this crossover, most desirably, should be as large as possible to insure good current efficiencies in anolytes already containing persulfate, whose sulfate concentrations have been reduced by the electrolysis.

The following examples are provided to illustrate this invention further. Proportions in the examples and throughout the specification are by weight and the temperatures are in degrees C. unless otherwise indicated.

SINGLE CELL EXAMPLES 1-5

Batch Operation

An electrolytic cell made of clear polymethyl methacrylate plastic was used in these examples.

The anode and cathode compartments of the cells were separated by porous alundum diaphragm material which was sealed in place using a silicone rubber caulking compound. Each compartment was provided with a glass tubing cooler, through which cool water was circulated. Agitation of the electrolytes was provided initially by means of mechanical stirrers; later air was introduced through sintered glass spargers to stir the electrolytes. The volumes of the anode and cathode compartments were adjusted as needed by insertion of inert plastic blocks.

The anode assembly consisted of platinum gauze 6.6 cm by 5.7 cm and the area of the platinum in the anode was 17.6 sq. cm. Facing the 37.62 sq. cm of platinum gauze of the anode, and on the other side of the diaphragm, were a lead cathode of 42.8 sq. cm on the side of the lead facing the anode, not including the area of the connectors. The anode and cathode assemblies were positioned on opposite sides of the diaphragm and about 0.5 cm from the diaphragm. Direct current for cell operation was obtained from a variable rectifier.

The initial catholyte compositions and initial anolyte compositions were aqueous solutions whose compositions are shown in Tables I and II. The cell operating conditions, calculated anode efficiency and percent conversion are also shown in Tables I and II. The examples of the invention are indicated by numbers 1 through 5 of Table II and comparison examples are indicated by letters A through G of Tables I and II.

Tables I and II show chronologically the experimental conditions used for batchwise electrolytes, and the results obtained. From Table I, proceeding from left to right, various conclusions can be drawn. First, very poor current efficiencies are obtained using initially neutral sodium sulfate anolytes. Addition of sulfuric acid increases current efficiencies, but not sufficiently, and addition of HF (a known polarizer) to that anolyte produces very little improvement. A neutral sodium sulfate anolyte containing sodium fluoride gave very poor current efficiency. Use of a sodium sulfate, ammonium sulfate sulfuric acid anolyte in the same apparatus then produced a very noticeable improvement. Return to neutral sodium sulfate, ammonium sulfate anolytes was accompanied by deterioration in current efficiency. Comparison of Run G with the immediately following runs 1-5 shows that use of a polarizer such as sodium fluoride, ammonium thiocyanate or thiourea improves current efficiencies by about 50%.

It thus appears that to obtain acceptable current efficiencies, the anolyte must contain a cation such as ammonium in addition to sodium, and a polarizer. Sodium appears to lower the current efficiency, particularly in the absence of ammonium ion, and the lowered current efficiency persists for some time even when a sodium-free anolyte is used. Similarly, once an anode is polarized and produces persulfate with high current efficiency, its high current efficiency will persist for some time even in an anolyte containing only sodium sulfate.

Effects of polarizers on current efficiencies are also similar with respect to the persistence of high anode efficiencies; remarkably, however, a polarizer seems able to lift poor current efficiencies immediately provided that amonium ion is present along with sodium ion in the anolyte. Almost invariably, current efficiencies in batch cell experiments increase slightly at the start of the electrolysis, probably because anode polarization is being completed during that time. Conversion percentages increase approximately linearly with time until they reach values where current efficiencies drop sharply, beyond which the conversion curve approaches 100% asymptotically.

EXAMPLES 6, 7 AND 8

Continuous Multiple Cell Electrolysis (8-Cell Cascade)

Eight cells were designed and made of clear polymethylmethacrylate. The anode and cathode compartments in each of the cells were separated by porous alundum diaphragm material which was sealed in place using a silicone rubber sealing compound. Each compartment was provided with a glass tubing cooler. Agitation of the electrolyte was provided by introducing air through sintered glass spargers. The volumes of the anode and cathode compartments were adjusted as needed by insertion of plastic blocks. The anode assembly consisted of two strips of platinum gauze 33 MM wide and 57 MM in height; the area of the platinum in each anode screen or coupon was 8.8 sq. cm. Facing the 37.62 sq. cm. of platinum gauze of the pair of coupon anodes, and on the other side of the diaphragm was a lead cathode with an area of 65 sq. cm. of the lead facing the anodes, not including the area of the lead tails of the cathodes which were used as lead-in conductors. The anode and cathode assemblies were positioned on opposite sides of the diaphragm and about ½ cm from the diaphragm. Direct current for cell operation was obtained from a variable rectifier.

The cells were connected in series so that the electrolytes can flow from cell to cell by gravity, a cascade arrangement. After the eight cell cascade was completely assembled, with each cell containing two gauze anodes connected together electrically outside each cell and a single 2 mm lead cathode with 65 sq. cm. of surface facing the anodes (excluding the area of the inch-wide tail of the cathode used as a lead-in), and, in each compartment, a tubular glass cooler, a sparger and a thermometer, the volumes of anode and cathode compartments were measured. With a zero flow through the cascade the average volume per anode compartment was found to be 243 milliliters and the average volume per cathode compartment 258 milliliters. The feed anolyte, prepared in a 30 gallon polyethylene drum, was pumped to a four liter glass constant head tank from which the excess anolyte returned by gravity to the 30 gallon tank. The constant head of anolyte then produced an adjustable flow of anolyte through a capillary, the vertical position of which determined the size of the flow. The desired constant flow of feed catholyte was obtained similarly. After passing through the first of the eight cascade cells the anolyte and catholyte streams overflowed by gravity into the second cell and thus eventually emerged from the eighth cell. The anolyte and catholyte flowed to the first cell through calibrated separatory funnels and the flow rates were determined with a stopwatch. The flow of 20% sulfuric acid was found to vary about 2% for each Centigrade degree when a capillary metering system was used; a constant temperature bath and heat exchangers were therefore used to maintain the electrolytes passing through the capillaries at a temperature between 29.5° and 30° C.

Cell temperatures were kept satisfactorily low by passing 14° C. cooling water through the glass coolers in each cell compartment. Two identical independent systems were used to supply cooling water to alternate cells to minimize effects of failure of either of the water supply systems.

Hydrogen is generated in persulfate cells at the cathode. To remove this hydrogen a hood was provided, and safety precautions were taken to insure that dangerous concentrations of hydrogen did not develop.

The initial catholyte composition, initial neutral anolyte feed composition, cell operating conditions, calculated anode efficiency, percent conversions and other variables and results of example 6 are also set forth in Table III. Similar data for examples 7 and 8 are set forth in Table IV.

EXAMPLE 9

The process was repeated in large electrolytic diaphragm cells which contained platinum gauze anodes and lead sheet cathodes separated by porous ceramic alundum diaphragms. A current density on the anode of 0.8 amps per square centimeter of cross-sectional area of platinum, that is the area of platinum wires facing the cathode, was employed. The anode feed was 10,000 pounds per hour of solution containing 23% by weight of sodium and ammonium sulfates in which 38% of the sulfate is ammonium sulfate; the solution was 55% water. The process used 199,400 amp hours passed through the anode solution in making 1,400 pounds of sodium persulfate per hour. The conversion of sulfur to peroxydisulfate was 80%. The anode product was passed to a vacuum crystallizer where 2,000 pounds of water were evaporated per hour to give 1,400 pounds per hour of crystal sodium peroxydisulfate product. The cathode feed to the process was 2,500 pounds per hour of a 45% sulfuric acid solution (45% sulfuric acid and 55% water). The mother liquor recovered from the crystallizer was mixed with the cathode product and neutralized with 941 pounds of 50% sodium hydroxide solution to produce anode feed which was returned to the beginning of the cyclic process.

TABLE I

| | A | B | C | D | E | F |
|---|---|---|---|---|---|---|
| Initial Anolyte Composition | | | | | | |
| % $Na_2SO_4$ | 21.9% | 15.3% | 14.7% | 11.5% | 19.7% | 25.1% |
| % $(NH_4)_2SO_4$ | | | | | 12.7 | 13.6 |
| % $Na_2S_2O_8$ | | | | | | |
| % $(NH_4)_2S_2O_8$ | | | | | | |
| % $H_2SO_4$ (94.6%) | | 28.5 | 27.4 | | 24.0 | |
| %NaF | | | | 1.7 | | |
| % 49% HF | | | 1.9 | | | |
| % $NH_4SCN$ | | | | | | |
| % $SC(NH_2)_2$ | | | | | | |
| Total Wt. Anolyte (g) | 324.9 | 359.5 | 374.2 | 321.9 | 465.9 | 429.2 |
| Initial Catholyte Composition | | | | | | |
| % $H_2SO_4$ | 44.0 | 44.0 | 44.0 | 44.0 | 44.0 | 44.0 |
| Wt $H_2SO_4$ (g) | 349.0 | 349.0 | 346.0 | | 356.5 | 380.6 |
| Cell Potential (volts) | 6.7 | 5.9 | 5.7 | 8.0 | 6.3 | 7.3 |
| Cell Current (amps) | 14 | 14 | 14 | 14 | 14 | 14 |
| Total Time of Electrolysis (min) | 85 | 87 | 88 | 44 | 151 | 100 |
| Cell Temperature ° C | 31 | 27 | 27 | 30 | 24 | 30 |
| Anode Current Efficiency (%) for period shown in parentheses (min) | 0.5(0–85) | 23.9(0–87) | 26.7(0–88) | 3.5(0–44) | 72.0(0–60)<br>69.7(60–120)<br>64.1(120–151) | 37.9(0–30)<br>40.4(30–60)<br>39.2(60–80)<br>36.2(80–100) |
| % Conversion after Electrolysis for times in parentheses (min) | 0.6 (85) | 11.6 (87) | 13.2 (88) | 4.2 (44) | 16.8 (60)<br>33.1 (120)<br>40.8 (151) | 8.0 (30)<br>16.4 (60)<br>21.7 (80)<br>26.5 (100) |

TABLE II

| | F | 1 | 2 | 3 | 4 | 5 |
|---|---|---|---|---|---|---|
| Initial Anolyte Composition | | | | | | |
| % $Na_2SO_4$ | 24.0 | 24.0 | 24.0 | 24.0 | 24.0 | 11.6 |
| % $(NH_4)_2SO_4$ | 12.0 | 12.0 | 12.0 | 12.0 | 12.0 | 8.5 |
| % $Na_2S_2O_8$ | | | | | | 16.2 |
| % $(NH_4)_2S_2O_8$ | | | | | | |
| % $H_2SO_4$ (94.6%) | | | | | | |
| % NaF | | 0.25 | | | | |
| % 49% HF | | | | | | |
| % $NH_4SCN$ | | | 0.04 | 0.04 | | 0.04 |
| % $SC(NH_2)_2$ | | | | | 0.027 | |
| Total Wt. Anolyte (g) | 1145 | 1124 | 1182 | 1205 | 1109 | 1823 |
| Initial Catholyte Composition | | | | | | |
| % $H_2SO_4$ | 33.2 | 30.0 | 30.0 | 30.0 | 30.0 | 25.0 |
| Wt $H_2SO_4$ (g) | 953.5 | 1285 | 1265 | 1310 | 1233 | 1219 |
| Cell Potential (volts) | 7.1 | 7.7(0–2hrs)<br>7.2(2–6hrs) | 8.3 | 7.6 | 7.5 | 7.15 |
| Cell Current (amps) | 19 | 19 | 14 | 14 | 14 | 14 |
| Total Time of Electrolysis (min) | 360 | 360 | 120 | 400 | 363 | 275 |
| Cell Temperature ° C | 34(0–2hrs)<br>24(2–6hrs) | 24 | 23.5 | 28 | 28 | 28 |
| Anode Current Efficiency (%) for period shown in parentheses (min) | 43.2(0–15)<br>43.5(15–30)<br>40.3(30–60)<br>37.2(60–122)<br>41.9(122–180)<br>44.2(180–240)<br>75.2(240–300)<br>42.8(300–360) | 81.1(0–15)<br>79.4(15–30)<br>80.8(30–60)<br>78.8(60–120)<br>69.8(120–182)<br>64.0(182–240)<br>48.3(240–300)<br>35.7(300–360) | 76.2(0–15)<br>89.0(15–30)<br>78.8(30–60)<br>88.0(60–120)<br>62.9(313–360) | 87.7(0–25)<br>86.9(25–30)<br>94.1(30–60)<br>89.5(60–91)<br>95.8(91–120)<br>91.7(120–180)<br>90.9(180–243)<br>74.0(243–313) | 83.8(0–15)<br>95.0(15–34)<br>93.6(34–61)<br>93.0(61–121)<br>95.1(121–180)<br>85.0(180–241)<br>75.2(241–300)<br>20.1(300–363) | 75.6(0–31)<br>90.5(31–60)<br>80.8(60–120)<br>88.1(120–181)<br>69.7(181–242)<br>63.5(242–275) |
| % Conversion after Electrolysis for times in parentheses (min) | 2.6 (15)<br>5.2 (30)<br>10.0 (60)<br>19.1 (122)<br>29.6 (180)<br>40.1 (240)<br>58.1 (300)<br>68.2 (360) | 5.0 (15)<br>9.7 (30)<br>19.5 (60)<br>38.7 (120)<br>56.0 (182)<br>71.1 (240)<br>82.8 (300)<br>91.5 (360) | 3.2 (15)<br>7.0 (30)<br>13.7 (60)<br>28.7 (120) | 6.1 (25)<br>7.4 (30)<br>15.1 (60)<br>22.9 (91)<br>30.7 (120)<br>45.9 (180)<br>61.8 (243)<br>76.3 (313) | 3.9 (15)<br>9.3 (34)<br>16.8 (61)<br>33.7 (121)<br>50.7 (180)<br>66.4 (241)<br>79.7 (300) | 48.1 (0)<br>52.0 (31)<br>56.5 (60)<br>64.7(120)<br>73.8 (181)<br>81.0 (242)<br>84.6 (275) |

TABLE III

| MULTIPLE CELL CONTINUOUS ELECTROLYSIS EIGHT CELL CASCADE | |
|---|---|
| Voltage on eight-cell cascade | 47.8 |
| Current through each cell (amps) | 14.0 |
| Anolyte Feed Rate (ml/min) | 40.5 |
| Anolyte Feed Specific Gravity | 1.300 |
| Anode Product Rate (ml/min) | 39.0 |
| Anode Product Specific Gravity | 1.301 |
| Catholyte Feed Rate (ml/min) | 15.2 |
| Catholyte Feed Specific Gravity | 1.137 |
| Cathode Product Rate (ml/min) | 16.0 |
| Cathode Product Specific Gravity | 1.126 |
| Anolyte Feed % $Na_2S_2O_8$ | 16.67 |
| Anolyte Feed % $Na_2SO_4$ | 11.63 |
| Anolyte Feed % $(NH_4)_2SO_4$ | 8.43 |
| Anolyte Feed $HSO_5$ (as % $NaHSO_5$) | 0 |
| Anolyte Feed % $H_2O_2$ | .03 |
| Anolyte Feed Acidity (as % $H_2SO_4$) | .09 |
| Anode Product % $Na_2S_2O_8$ | 28.38 |
| Anode Product % $Na_2SO_4$ | 2.20 |
| Anode Product % $(NH_4)_2SO_4$ | 6.66 |
| Anode Product $HSO_5^-$ (as % $NaHSO_5$) | .33 |
| Anode Product % $H_2O_2$ | .03 |
| Anode Product Acidity (as % $H_2SO_4$) | 1.19 |
| Cathode Product % Na | 2.9 |
| Cathode Product % $NH_3$ | 1.56 |
| Cathode Product Acidity (meg/g) | 0.826 |
| % $(NH_4)_2SO_4$/(% $(NH_4)_2SO_4$ + % $Na_2SO_4$) | |
| in Anode Feed | 41.77 |
| in Anode Product | 62.94 |
| Conversion (%) | |
| in Anode Feed | 48.86 |
| in Anode Product | 74.77 |
| Current Efficiency (%) | 70.70 |
| % of ion current carried by: | |
| $H^+$ | 15.26 |
| $NH_4^+$ | 23.74 |
| $Na^+$ | 32.62 |
| $SO_4^=$ | 28.38 |
| Mols $H_2O$/Faraday through Diaphragm | .784 |

TABLE IV

| | Example 7 | Example 8 |
|---|---|---|
| Current through each cell (amps) | 13.8 | 14.0 |
| Anolyte Feed Rate (ml/min) | 33.67 | 36.76 |
| Anolyte Feed Specific Gravity | 1.357 | 1.360 |
| Anode Product Rate (ml/min) | 32.75 | 33.90 |
| Anode Product Specific Gravity | 1.358 | 1.359 |
| Catholyte Feed Rate (ml/min) | 9.12 | 12.88 |
| Catholyte Feed Specific Gravity | 1.318 | 1.1744 |
| Cathode Product rate (ml/min) | 10.03 | 13.45 |
| Cathode Product Specific Gravity | 1.267 | 1.160 |
| Anolyte Feed % $Na_2S_2O_8$ | 21.66 | 18.15 |
| Anolyte Feed % $Na_2SO_4$ | 13.20 | 13.29 |
| Anolyte Feed % $(NH_4)_2SO_4$ | 9.50 | 9.63 |
| Anolyte Feed $HSO_5$ (as % $NaHSO_5$) | .13 | .12 |
| Anolyte Feed % $H_2O_2$ | .01 | .02 |
| Anolyte Feed Activity (as % $H_2SO_4$) | .06 | .10 |
| Anode Product % $Na_2S_2O_8$ | 35.32 | 30.67 |
| Anode Product % $Na_2SO_4$ | 1.77 | 3.94 |
| Anode Product % $(NH_4)_2SO_4$ | 7.75 | 8.54 |
| Anode Product $HSO_5$ (as % $NaHSO_5$) | .46 | 1.08 |
| Anode Product % $H_2O_2$ | .01 | .01 |
| Anode Proudct Acidity (as % $H_2SO_4$) | 1.25 | 1.41 |
| Cathode Product % Na | 4.05 | 3.60 |
| Cathode Product % $NH_3$ | 1.84 | 1.45 |
| Cathode Product Acidity (meq/g) | 3.33 | 1.151 |
| % $(NH_4)_2SO_4$/% $(NH_4)_2SO_4$ + % $(Na_2SO_4)$ | | |
| in Anode Feed | 41.70 | 41.75 |
| in Anode Product | 68.41 | 58.48 |
| Conversion (%) | | |
| in Anode Feed | 52.23 | 47.50 |
| in Anode Product | 77.27 | 69.08 |
| Current Efficiency (%) | 74.12 | 69.98 |
| % of ion current carried by: | | |
| $H^+$ | 14.86 | 12.70 |

TABLE IV-continued

| | Example 7 | Example 8 |
|---|---|---|
| $NH_4^+$ | 20.04 | 19.11 |
| $Na^+$ | 32.60 | 35.07 |
| $SO_4^=$ | 32.50 | 33.12 |
| Mols $H_2O$/Faraday through Diaphragm | 0.859 | 0.776 |

What is claimed is:

1. A process for the direct electrolytic production of sodium peroxydisulfate with high current efficiencies in an electrolytic cell having a protected cathode comprising direct electrolysis of a neutral aqueous anolyte feed solution containing by weight initially 5 to 9% sodium ions, 12 to 30% sulfate ions, 1 to 4% ammonium ions and an effective amount of a polarizer, using a sulfuric acid solution as the cell catholyte and an electric current density of at least 0.5 amperes per square centimeter of surface of the anode.

2. The process of claim 1 in which the anode is platinum.

3. The process of claim 1 further comprising an initial anolyte solution containing 6 to 30% peroxydisulfate ions.

4. The process of claim 1 in which the polarizer is a thiocyanate or cyanamide.

5. The process of claim 1 in which the salts dissolved in solution amount to between 10 and 50% of the weight of the solution.

6. The process of claim 1 in which the temperature is between 10° and 40° C.

7. The process of claim 1 in which the cell temperature is maintained between 20° and 35° C.

8. The process of claim 1 in which the current density is between 0.5 and 2 amperes per square centimeter of surface of the anode.

9. The process of claim 1 in which the cathode is lead.

10. The process of claim 1 in which the process is conducted as a continuous cyclic process in a plurality of electrolytic cells having a protected cathode in the presence of an effective amount of a polarizer comprising preparing a solution containing a sufficient amount of a mixture of sulfates and peroxydisulfates of sodium and ammonium to provide a neutral anolyte solution containing, by weight, at least 50% water, 18–30% total sulfates of which at least 35% of the total sulfate is ammonium sulfate, electrolyzing the anolyte while passing it sequentially through a series of electrolytic cells at a temperature of 10° to 40° C., using a sulfuric acid solution as the catholyte, and using a current density equivalent to at least 0.5 amperes per square centimeter of platinum on the anode surface, recovering the sodium peroxydisulfate from the anolyte, mixing the liquor separated from the recovered peroxydisulfate with the cathode product, neutralizing this solution with a basic sodium compound and recycling this neutral solution to the anode side of the electrolytic cells.

11. The process of claim 10 in which the temperature in the cells is maintained between 20° C. and 30° C.

12. The process of claim 10 in which the current density is between 0.5 and 1.5 amperes per square centimeter of surface of the anode.

* * * * *

UNITED STATES PATENT AND TRADEMARK OFFICE

CERTIFICATE OF CORRECTION

PATENT NO. : 4,144,144

DATED : 13 March 1979

INVENTOR(S) : Kenneth J. Radimer; Michael J. McCarthy

It is certified that error appears in the above-identified patent and that said Letters Patent are hereby corrected as shown below:

Column 3, line 30, "analyte" should read --anolyte--; line 32, "analyte" should read --anolyte--. Column 4, line 58, "electrolytes" should read --electrolyses--. Column 5, line 46, "33 MM" should read --33 mm--; line 47, "57 MM" should read --57 mm--. Column 9, in Table IV, at about line 54, "Anode Proudct Acidity" should read --Anode Product Acidity--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*